US007849809B2

(12) United States Patent
Gale

(10) Patent No.: US 7,849,809 B2
(45) Date of Patent: Dec. 14, 2010

(54) YACHT AND BALLAST ASSEMBLY THEREFOR

(76) Inventor: Robert William Gale, 26 Dargie Street, Everton Park, Brisbane, Queensland (AU) 4053

( * ) Notice: Subject to any disclaimer, the term of this patent is extended or adjusted under 35 U.S.C. 154(b) by 171 days.

(21) Appl. No.: 12/295,886

(22) PCT Filed: Apr. 4, 2007

(86) PCT No.: PCT/AU2007/000447

§ 371 (c)(1),
(2), (4) Date: Oct. 3, 2008

(87) PCT Pub. No.: WO2007/115361

PCT Pub. Date: Oct. 18, 2007

(65) Prior Publication Data

US 2009/0158983 A1 Jun. 25, 2009

(30) Foreign Application Priority Data

Apr. 7, 2006 (AU) ..... 2006201460

(51) Int. Cl.
*B63B 39/02* (2006.01)
*B63B 39/03* (2006.01)
*B63B 43/08* (2006.01)

(52) U.S. Cl. ..... 114/124

(58) Field of Classification Search ..... 114/121, 114/123, 124, 140
See application file for complete search history.

(56) References Cited

U.S. PATENT DOCUMENTS

| | | | | |
|---|---|---|---|---|
| 3,557,735 | A * | 1/1971 | Dreyfus et al. | 114/124 |
| 3,934,535 | A * | 1/1976 | Culver | 114/124 |
| 4,094,263 | A | 6/1978 | Marcil | |
| 4,610,212 | A * | 9/1986 | Petrovich | 114/39.26 |
| 4,817,550 | A * | 4/1989 | Gutsche | 114/124 |
| 5,280,760 | A | 1/1994 | Edwards | |
| 5,908,005 | A | 6/1999 | Everett | |
| 6,606,957 | B2 * | 8/2003 | Matthews | 114/85 |

FOREIGN PATENT DOCUMENTS

| | | |
|---|---|---|
| EP | 1306300 | 5/2003 |
| FR | 2552391 | 3/1985 |
| FR | 2626240 | 7/1989 |
| GB | 922977 | 4/1963 |
| WO | 01/89920 | 11/2001 |

* cited by examiner

*Primary Examiner*—Daniel V Venne
(74) *Attorney, Agent, or Firm*—Shoemaker and Mattare

(57) ABSTRACT

A yacht having an adjustable ballast assembly comprising a ballast, an elongated hollow ballast guide o mounted to the hull of the watercraft to extend transversely of the hull, the ballast being located within the guide and there being means for selectively moving the ballast longitudinally of the guide between respective opposite end positions in which at least part of the ballast is located laterally outwardly of the hull. The elongated guide may be located within an outer hollow guide and mounted for longitudinal movement relative to the outer guide so as to be capable of projecting telescopically from opposite ends of the outer guide.

10 Claims, 9 Drawing Sheets

YACHT AND BALLAST ASSEMBLY THEREFOR

TECHNICAL FIELD

This invention relates to a yacht having a ballast assembly therefor. The present invention also relates to an adjustable ballast assembly for yachts.

BACKGROUND ART

Monohull yachts are provided with fixed or retractable keels, the purpose of which is to enable the yacht to beat to windward with a minimum amount of heel. By minimising heeling of the yacht, the underwater hull is maintained as close to symmetrical as possible and thus the smallest rudder angle is necessary to prevent the yacht rounding up. By maintaining the rudder angle at a minimum, drag is minimised. Further when a yacht is substantially upright, the sail is operating at a maximum efficiency. Maintaining a yacht upright is also important in cruising yachts where a large crew is not available and comfort is important.

A keel additionally has the effect of reducing the amount of drift of the yacht to leeward when beating to windward. A keel further has the advantage of permitting the boat to carry the maximum amount of sail for a given wind strength for maximum speed. Conventional keels however have a number of disadvantages. In particular keels require a yacht to heel before the righting moment of the keel comes into effect. Keels also usually substantially increase the draft of a yacht which therefore, particularly in larger yachts, limits the waterways in which the yacht may be used. Whilst some yachts can be provided with retractable centreboards or swing keels which may be weighted, this is a compromise which is not suited in all applications and can have the disadvantage of comprising accommodation within the yacht.

To overcome some of the above disadvantages of conventional keels, some of the large yachts are provided with a canting keel which is mounted for pivotal movement relative to the longitudinal centreline of the hull, the keel usually including a weighted bulb at its lower end to provide maximum righting movement and having an upper end which projects into the hull. Whilst such keels have proven to be effective in use and improve the speed of yachts, their design and implementation has to address significant structural, safety and cost problems. The canting keel also does not prevent sideways drift to leeward and therefore an additional dagger board or canard is often required.

A yacht may be provided with a movable water ballast which overcomes the mechanical disadvantages of a canting keel but has the disadvantage of increasing the wetted surface of the yacht hull. Furthermore as the water ballast is wholly within the hull, it is less effective that a canting keel in that it has a smaller righting moment for its weight.

Another proposal has been to use a movable weight within a hull which is moved to provide the require righting moment depending upon the manner in which the yacht is sailing however such as arrangement is constrained by the hull extremities and has inadequate righting moment.

Multihull vessels overcome the problem of having a large keel depending from a hull or hull of a watercraft however multihulls have the disadvantage that they have excessive beam which makes it difficult for them to be accommodated in marinas at a reasonable cost.

SUMMARY OF THE INVENTION

The present invention aims to provide in one aspect a yacht having an improved ballast assembly and in particular to a ballast assembly which can provide sufficient righting moment to enable elimination of or reduce the size of a conventional weighted keel. The present invention further aims to provide an improved ballast assembly for yachts. Other objects and advantages of the invention will become apparent from the following description.

The present invention thus provides in one aspect a monohull yacht having a hull and an adjustable ballast assembly, said ballast assembly comprising a ballast, said ballast being mounted to said hull below the waterline thereof for movement transversely of and through said hull and between opposite end positions in which at least part of said ballast is located laterally outwardly of said hull respectively, and means for selectively moving said ballast between said opposite end positions.

Most preferably the ballast is mounted for movement relative to the hull such that in its opposite end positions, the centre of gravity of the ballast is positioned laterally outwardly of opposite sides of the hull. In the opposite end positions, the ballast may be positioned wholly outwardly of the hull.

Suitably elongated ballast guide means are supported to the hull for guiding movement of the ballast. Preferably mounting means are provided to mount the guide means substantially internally of the hull.

In one preferred form, the guide means comprises an elongated hollow guide member and the ballast is located within the hollow guide member. Preferably in this form, the means for selectively moving the ballast along the guide member comprises means for moving the ballast between opposite ends of the guide member.

The hollow guide member may be fixedly mounted to the hull. The guide member may be mounted to the hull so as to extend laterally outwardly of opposite sides of the hull. Preferably the portions of the guide member which extend laterally outwardly of opposite sides of the hull extend substantially equally from the hull on opposite sides thereof. The guide member may extend up to or beyond the maximum beam of the hull so that the ballast can be moved to extended positions laterally of the hull. The guide member however may terminate at or inwardly of the maximum beam of the hull.

The guide member most preferably extends transversely of the hull in a lower portion of the hull below the waterline. The guide member may be formed with the hull during construction of the hull or retrofitted to the hull for example by providing aligned openings in opposite sides of the hull to receive the first guide member therethrough. Where the hull is constructed of a reinforced plastics or the like, the guide member may be glassed into the hull or fixed in position by an adhesive or resin.

The guide member is suitably sealed or closed at opposite ends so that water is prevented from entering the guide member.

In a particularly preferred form, the guide member comprises a first guide member and is adapted to be mounted to the watercraft hull by means of a second outer elongated hollow guide member. Preferably the first guide member extends longitudinally of and is located within the second guide member for longitudinal movement in opposite directions so as to be capable of extending telescopically outwardly of opposite ends of the second guide member. The second outer guide member is suitably fixedly mounted to and located at least within the hull and extends transversely thereof. The second outer guide member however may be mounted to the hull so as to extend laterally outwardly of opposite sides of the hull. Preferably where the second guide member extends laterally outwardly of opposite sides of the hull, the portions of the second outer guide member which extend laterally outwardly of opposite sides of the hull extend substantially equally from the hull on opposite sides thereof. It is preferred that the second outer guide member does not extend beyond the maximum beam of the hull so as not to increase the maximum hull beam. The second outer guide member may however extend beyond the maximum beam of the hull.

In another preferred form, the second outer guide member does not extend laterally beyond opposite sides of the hull. Thus the second outer guide member may terminate substantially flush with opposite sides of the hull. The first guide member however being movable within the second guide member may extend telescopically beyond the opposite ends of the second guide member and thus laterally outwardly of the hull to permit the ballast located therein to move laterally outwardly of the hull.

The second guide member may be formed with the hull during construction of the hull or retrofitted to the hull for example by providing aligned openings in opposite sides of the hull to receive the second guide member therethrough. Where the hull is constructed of a reinforced plastics or the like, the second guide member may be glassed into the hull or secured therein by any suitable adhesive or resin.

Preferably at least opposite end portions of the first guide member which are capable of projecting beyond the ends of the second guide member are of an external shape so as to reduce drag within water. Most preferably the first guide member comprises a member having at least in its opposite end portions and preferably throughout its length a cross section of the external shape of an aerofoil or wing referred to hereinafter as a "foil". The foil suitably comprises a symmetrical foil but may be an asymmetrical foil. The first guide member however may have any other external configuration such as by being of an oval shape or sharp edge section.

Preferably, where the second guide member has end portions which extend outwardly beyond opposite side of the hull, the second guide member is of a shape at least in its portions extending so as to reduce drag within water. Most preferably the second guide member or at least the extending portions thereof have in cross section the external shape of a foil which may be symmetrical or asymmetrical as referred to above. The second guide member or extending portions thereof however may have any other external configuration such as by being of an oval shape or sharp edge section.

In a particularly preferred form, the first guide member has an external foil configuration substantially complementary to the internal configuration of the second outer guide member. Preferably also the first guide member is of substantially the same length as the second guide member such that it may be located wholly therein when in a central position. The first guide member however may of greater or less length than the second guide member.

Friction reducing means may be provided to allow for smooth sliding movement of the first guide member within the second guide member. The friction reducing means may comprise friction reducing slides or pads sandwiched between the first and second guide members. The slides or pads may be provided on the upper and lower sides of the first guide member to allow the first guide member to be moved longitudinally of the second guide member if the yacht is inverted. Alternatively the friction reducing means may comprise wheels or bearings such as bearings provided on one or both of the first and second guide members and cooperating with the other of the first or second guide members. The slide, wheels or bearings may be formed of Telflon or any other friction reducing material.

Any suitably adjusting means may be provided for moving the first guide member relative to the second guide member. Such means may comprise a cable/line and pulley, a screw jack, or rack and pinion. The adjusting means may be manually operated or actuated by electric or hydraulic means such as electric or hydraulic motors or combinations thereof.

Where the adjusting means is electrically or hydraulically actuated, means may be provided to automatically adjust the position of the first guide member. The first guide member may be adjusted automatically in response to selected parameters relating to operation of the yacht. Sensing means may be provided to sense one or more parameters of the yacht and the adjusting means may be associated with the sensing means to adjust the position of the first guide member in accordance with the parameter sensed. For example, the sensing means may sense heel of the yacht or sense when the yacht heel is not within a predetermined range. The sensing means may alternative sense other motion of the yacht. Thus the adjusting means may automatically adjust the position of the first guide member for example to compensate for a sudden drop in wind speed or to allow for an emergency tack.

Manually operated means associated with the adjusting means may also be provided to centralize or relocate the first inner hollow member for example if an emergency situation arises.

The ballast may comprise a single ballast or two or more ballasts and thus the term "ballast" as used throughout the specification and claims includes one or two or more ballasts. Where the ballast comprises two or more ballasts, each ballast may be moved independently of the other ballasts.

The ballast may be formed of any suitable material but preferably for the highest specific gravity at least cost, comprises lead. The ballast however may comprise, iron, steel or tungsten. The ballast may be provided in sections however the ballast preferably comprises a trolley or carriage which carries one or more ballast weights to enable the total weight of the ballast to be readily adjusted. The ballast suitably has an external configuration which is substantially complementary to the internal configuration of the first guide member. Preferably the ballast and guide means are configured such that in either of its opposite end positions and as referred to above, its centre of gravity is located laterally outwardly of the hull. The ballast and guide means may be configured such that it is wholly external of the hull in either of its opposite end positions. Thus the ballast may have a length relative to the length of the guide means such that the center of gravity of the ballast is located laterally outwardly of the hull in an end position.

Friction reducing means may be provided to allow for smooth longitudinal movement of the ballast within the first guide member. The friction reducing means may comprise friction-reducing slides or pads sandwiched between the ballast and first guide member. The slides or pads may be provided on the upper and lower sides of the ballast to allow the ballast to still be moved longitudinally within the first guide member if the yacht is inverted. Alternatively the friction reducing means may comprise wheels or bearings such as bearings provided on one or both of the ballast and first guide members and cooperating with the other of the ballast or first guide member. The slides, wheels or bearings may be formed of Teflon or any other friction reducing material.

Any suitably means may be provided for moving the ballast within and relative to the first guide member. Such means may comprise a cable/line and pulley, a screw jack or rack and pinion. The adjusting means may be manually operated or actuated by electric or hydraulic means such as electric or hydraulic motors or combinations thereof.

Where the adjusting means is electrically or hydraulically actuated, means may be provided to automatically adjust the position of the ballast. The ballast may be adjusted automatically in response to selected parameters relating to operation of the yacht. Sensing means may be provided to sense one or more parameters of the yacht and the adjusting means may be associated with the sensing means to adjust the position of the ballast in accordance with the parameter sensed. For example, the sensing means may sense heel of the yacht or sense when the yacht heel is not within a predetermined range. The sensing means may alternative sense other motion of the yacht. Thus the adjusting means may automatically adjust the ballast for example to compensate for a sudden drop in wind speed or to allow for an emergency tack.

Manually operated means associated with the adjusting means may also be provided to centralize or relocate the ballast for example if an emergency situation arises.

Preferably the ballast remains wholly within the first hollow guide member in all positions so that the first guide member may be sealed at opposite ends to prevent entry of water into the first guide member. Alternatively the ballast may in its opposite end positions protrude beyond the opposite ends of the first guide member.

The ballast assembly of the invention most preferably is used in combination with a keel or weighted dagger board or centerboard so that the yacht can resist lateral movement. The keel may be fixed to the hull or be fully or partly retractable into the hull.

Whilst a yacht may include only one ballast assembly, it may include two or more ballast assemblies spaced apart along the hull. The ballast assemblies may be located forward and aft of the keel or dagger board of the yacht. The term "yacht" as used throughout the specification includes any form of sailing craft.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE PREFERRED EMBODIMENT

Figure 1:
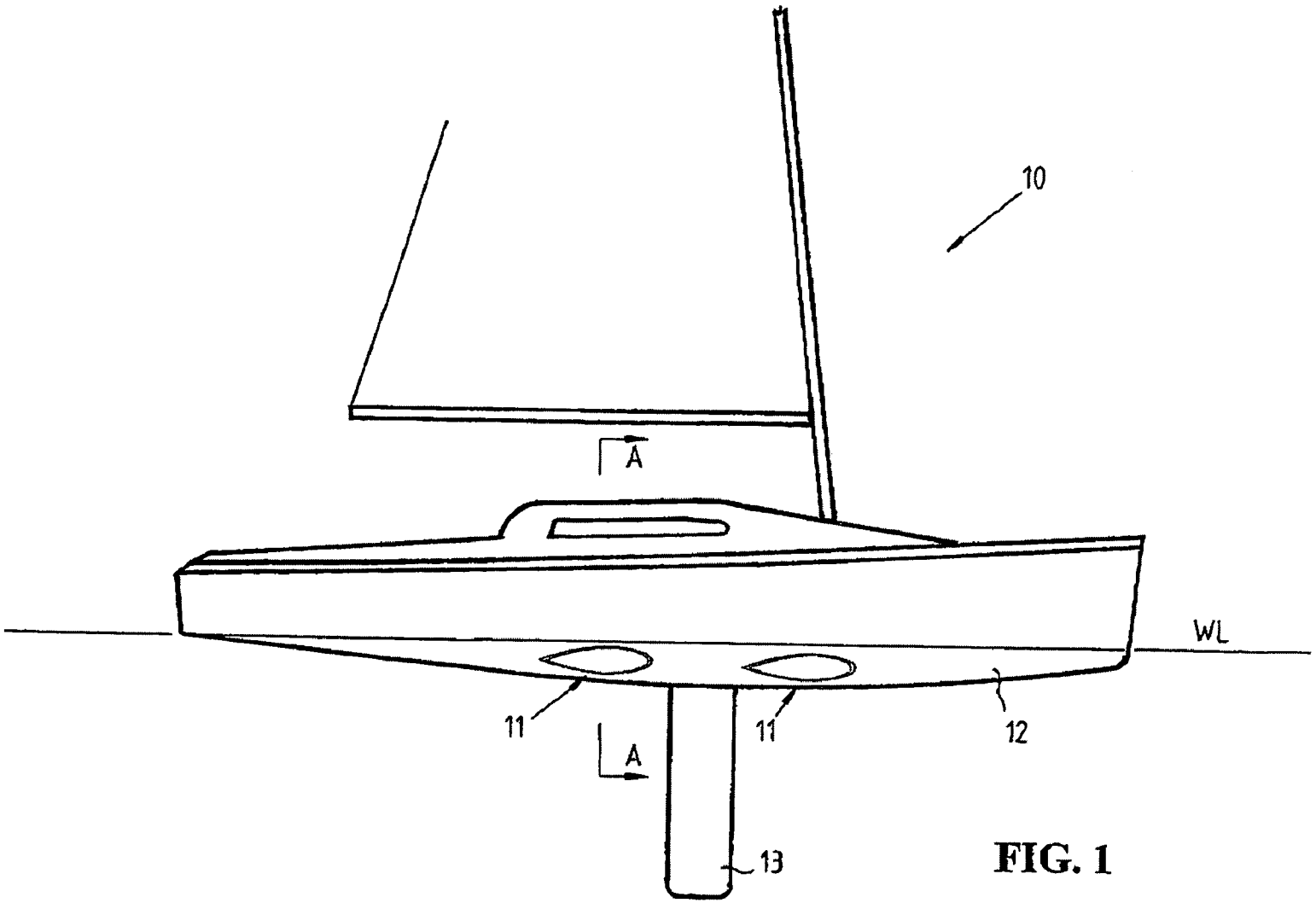
FIG. 1 illustrates in schematic side elevation, a yacht provided with ballast assemblies according to an embodiment of the present invention.

Referring to the drawings and firstly to FIG. 1, there is illustrated a yacht 10 incorporating ballast assemblies 11 according to the present invention mounted to the hull 12 of the yacht 10 below the waterline WL. In this case the yacht 10 is a mono-hull centreboard yacht having a retractable dagger board 13. It will be appreciated however that a ballast assembly 11 of the present invention may be applied to other yachts including yachts with fixed keels. Further in the illustrated embodiment, the yacht 10 has two ballast assemblies 11 forward and aft respectively of the dagger board 13. A yacht however may be provided with a single ballast assembly 11 arranged amidships or any other desired location along the hull 12.

Figure 2:
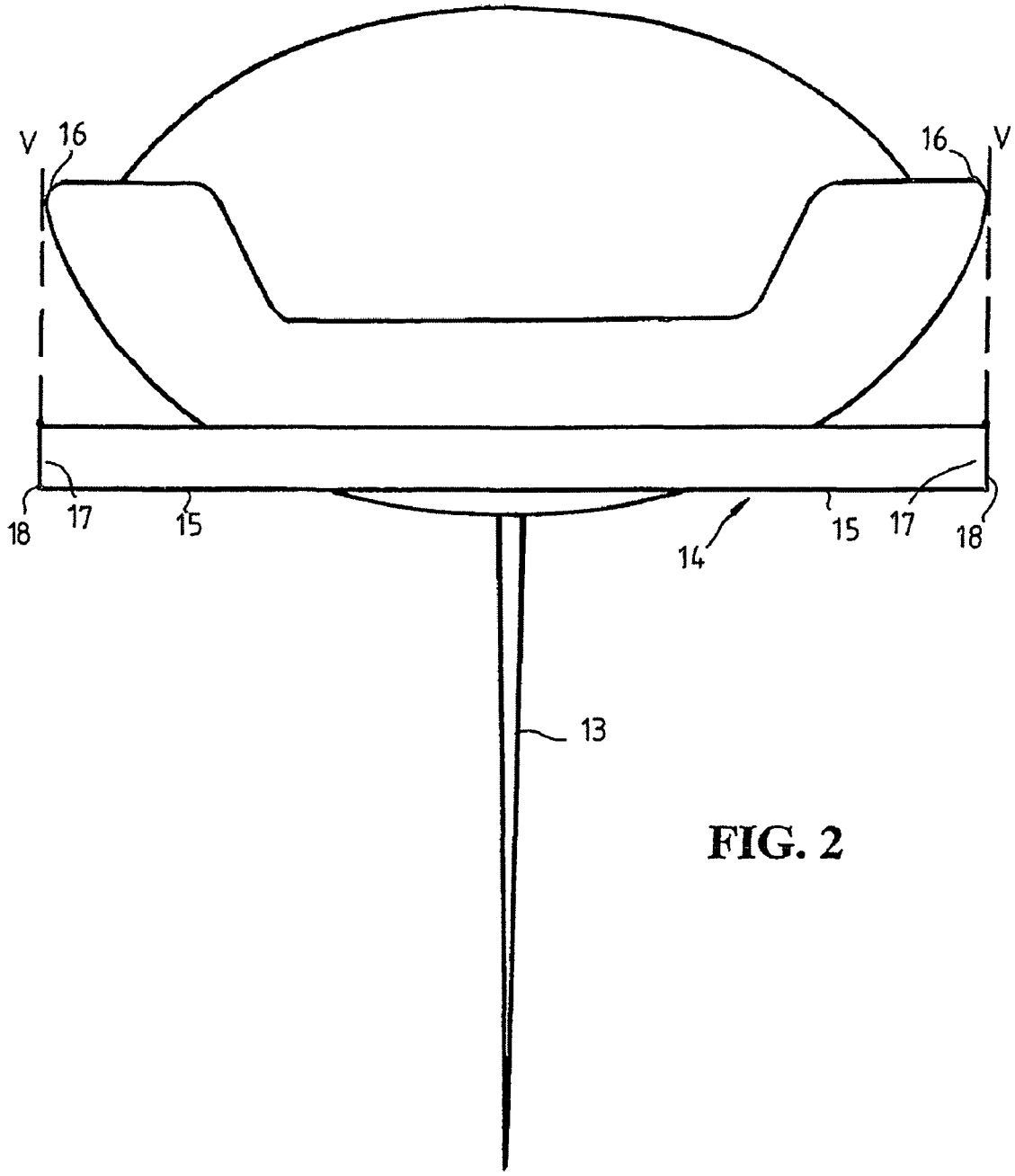
FIG. 2 is a schematic cross sectional view of the yacht of FIG. 1 along line A-A showing the outer guide member or tunnel of the ballast assembly installed within the yacht.

Each ballast assembly 11 comprises as illustrated more clearly in FIG. 2 an elongated hollow guide member 14 which extends transversely abeam of and through the hull 12 of the yacht 10. In this embodiment, the hollow member 14 is positioned at a lower portion of the hull 12 below the waterline and has end portions 15 which project outwardly of the hull 12 on opposite sides thereof. Suitable sealing means are provided to seal the guide member 14 to the hull 12. The opposite end portions 15 of the hollow member 14 however preferably do not extend on opposite sides of the hull 12 beyond vertical planes marked V containing or immediately adjacent to the gunwales 16 above the hollow member 14. Thus the maximum beam of the hull 12 is not increased by the member 14 which thereby enables the yacht 10 to be berthed for example in a marina as would be a conventional yacht.

The member 14 is open at opposite ends 17 however the ends 17 are normally closed by fairings or covers 18 which may be spring mounted to the end portions 15 adjacent the ends 17 so as to close the ends 17 automatically. Alternatively, the fairings 18 may be closed manually. In another arrangement, the ends 17 of the member 14 may be closed by removable end plugs or caps.

Figure 3:
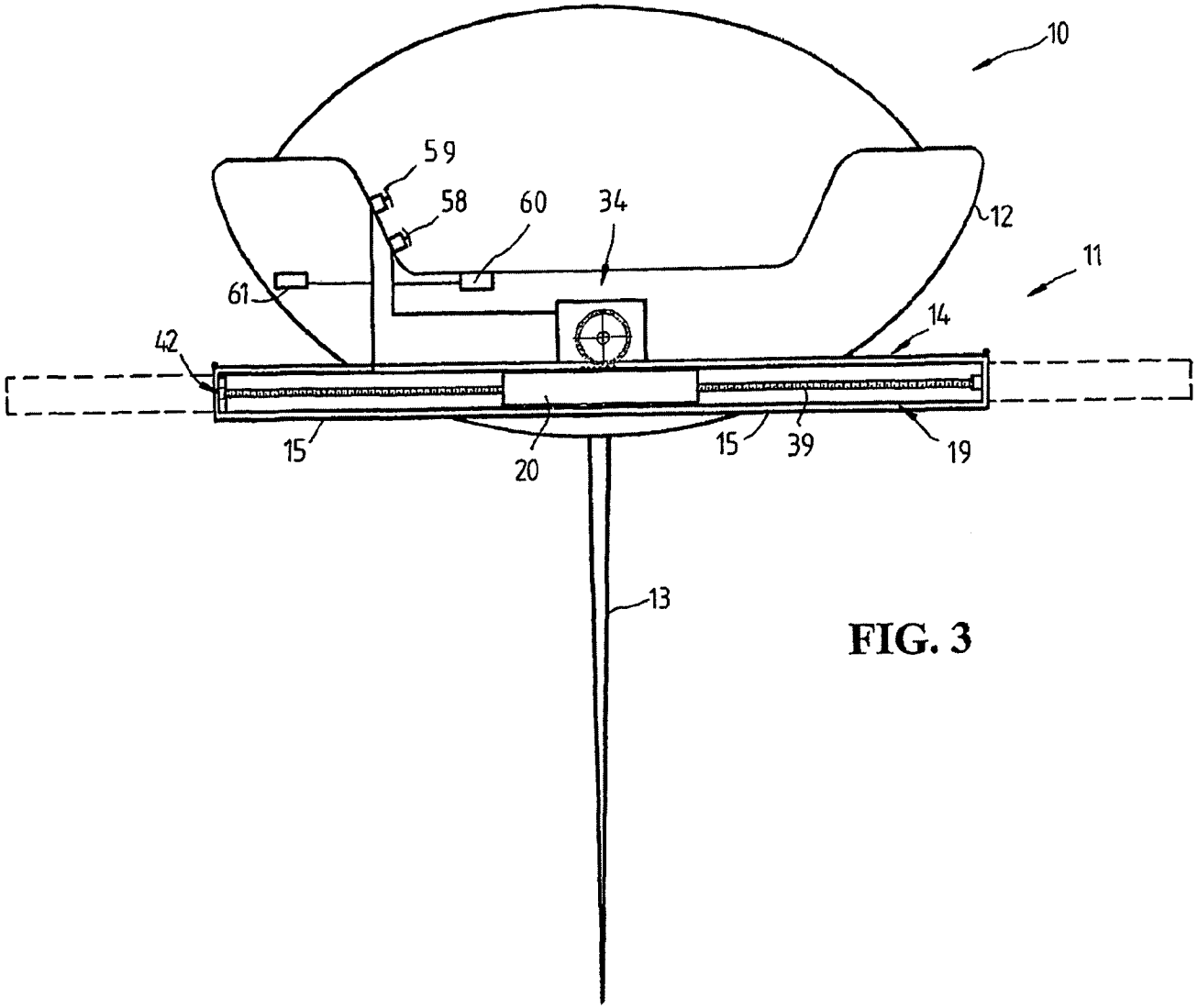
FIG. 3 is a schematic cross sectional view of the yacht of FIG. 1 corresponding to the view of FIG. 2 showing the inner guide member and ballast located within the outer guide member and centered relative to the hull.

Mounted within the outer hollow member 14 as shown in FIG. 3 is an inner elongated hollow guide member 19 which is supported for movement longitudinally of the member 14 and capable of projecting outwardly of opposite ends 15 thereof in a telescopic manner as described further below. The inner member 19 in the illustrated embodiment is closed at each end and substantially the same length as the outer hollow member 14 so as to be located wholly therein when centered relative to the hull 12. The inner member 19 however is capable of movement longitudinally relative to the outer member 14 such that it may project telescopically outwardly of opposite end portions 15 of the member 14 and be supported in a cantilever-like manner from the outer member 14. A ballast 20 is located within the inner hollow member 19 and capable of longitudinal movement within the inner member 19.

Figure 5:
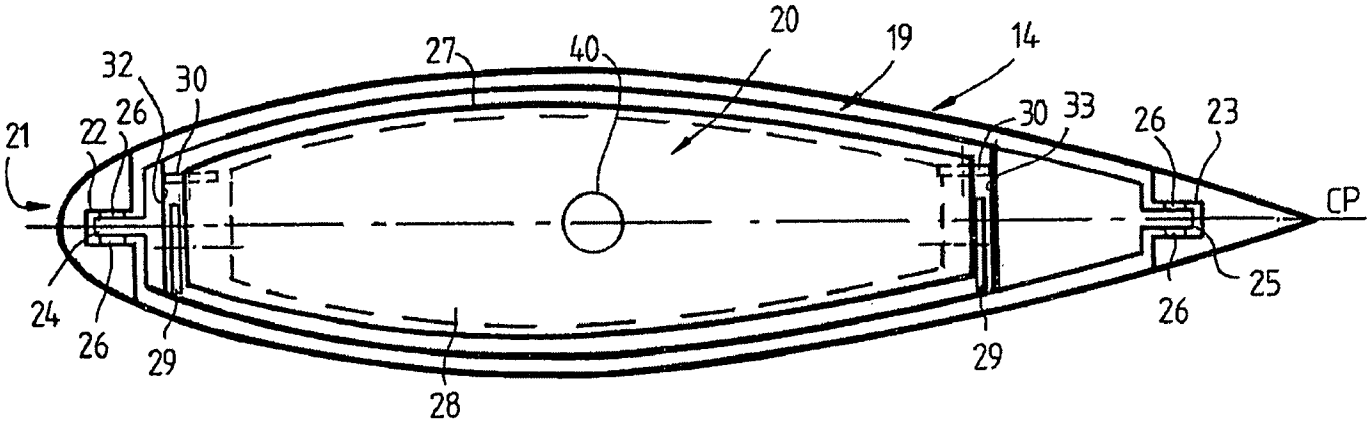
FIG. 5 is an enlarged cross sectional view of the ballast assembly along lines B-B of FIG. 3.

The hollow outer member 14 as illustrated in FIG. 5 has the external cross section of symmetrical foil with the leading end 21 at a forward position relative to the bow of the yacht 10. In addition, the foil sectioned member 14 has a zero angle of attack such that the chordal plane CP of the member 14 which contains its longitudinal centreline is substantially horizontal when the hull 12 is in an upright unheeled attitude.

The inner hollow member 19 is also of a generally symmetrical foil-shaped external configuration in cross section substantially complementary to the internal configuration of the outer hollow member 14. To locate the inner hollow member 19 in the hollow member 14 and to enable the inner hollow member 19 to slide longitudinally of the outer hollow member 14, the outer hollow member 19 includes central slots 22 and 23 at its leading and trailing ends respectively aligned with the chordal plane CP into which fins 24 and 25 at the leading and trailing ends of the inner hollow member 19 extend. To facilitate smooth sliding movement of the fins 24 and 25 within the slots 22 and 23, thin strips 26 of friction reducing material such as Teflon are provided between the fins 24 and 25 and walls of the slots 22 and 23 on opposite sides of the fins 24 and 25.

The ballast 20 is defined by a ballast carrier or trolley 27 which carries weights 28 (shown in dotted outline) sufficient to provide the required ballast weight. The carrier 27 has an external cross section substantially complementary to the inner cross section of the inner hollow member 19. To support the ballast 20 for smooth longitudinal movement within the hollow member 19, horizontal axis rollers 29 and vertical axis rollers 30 are mounted at the leading and trailing ends of the carrier 27. The horizontal axis rollers 29 are mounted to the carrier 27 at spaced the positions along the carrier 27 and run along the inner surface 31 of the hollow member 19 to support the weight of the ballast 27 (see also FIG. 4). The vertically axis rollers 30 which are also provided at spaced positions along the carrier 27 are mounted to the carrier 27 and act between the carrier 27 and end inner surfaces 32 and 33 at the leading and trailing ends of the inner hollow member 19 to centralise the carrier 27 in a fore and aft direction.

The carrier 27 in this embodiment comprises a trolley of stainless steel and the weights 28 comprise shaped lead ingots. The inner hollow member 19 may be constructed of steel, aluminium or a reinforced plastics for example a carbon fibre composite or combinations of the foregoing. The outer hollow member 14 may be of a similar construction.

Figure 6:
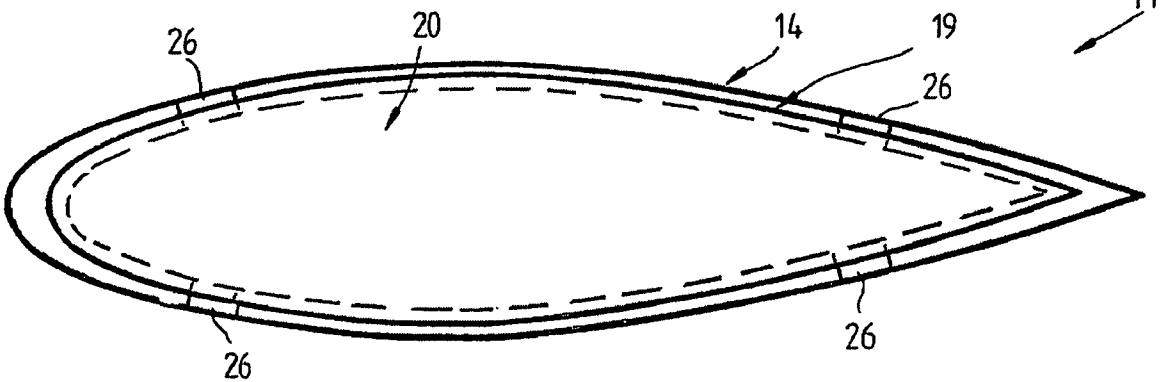
FIG. 6 is an enlarged cross sectional view of the ballast assembly corresponding to the view of FIG. 5 showing an alternative slide assembly.

FIG. 6 illustrates in sectional view a further simplified form of ballast assembly 11 in which the outer guide member 14 is as above in the configuration of a symmetrical foil and the inner guide member has the external configuration of a symmetrical foil complementary to the inner surface of the outer guide member 14. Slides or friction reducing members 26 similar to the slides or strips 26 of FIG. 5 are sandwiched between the outer surface of the inner guide member 14 and inner surface of the outer guide member 19. This allows for smooth sliding movement of the member 14 relative to the member 19 irrespective of the orientation of the ballast assembly 11. Similar slides (not shown) are provided between the ballast 20 and inner guide member 19 to allow smooth sliding movement of the ballast 20 relative to the guide member 19.

Figure 4:
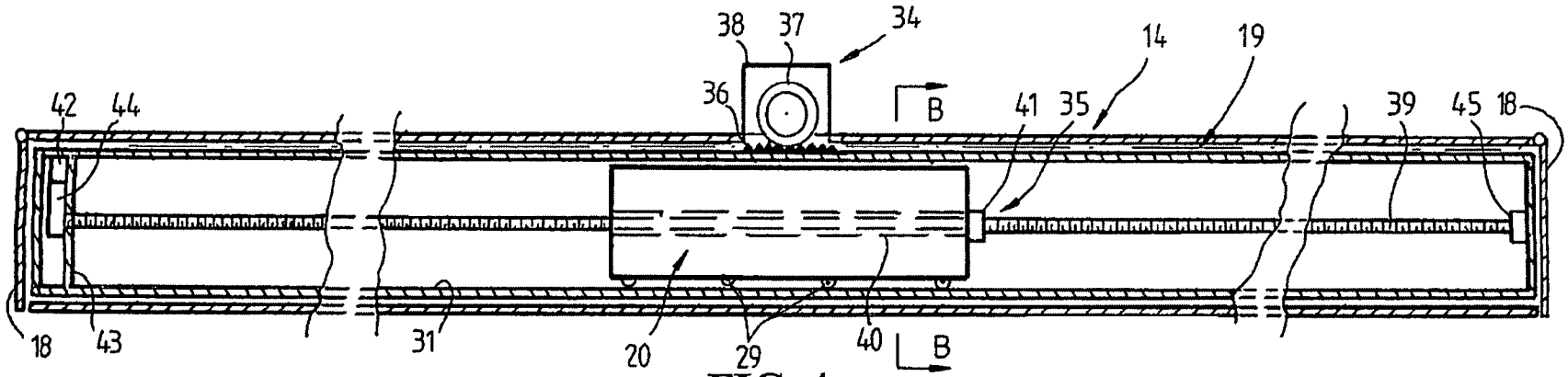
FIG. 4 is a schematic longitudinal sectional view of the ballast assembly as used in the yacht of FIG. 1 with the ballast weight centered.

A number of different adjustment mechanisms may be used to adjust the position of the inner hollow member 19 longitudinally relative to the outer hollow member 14 and the ballast 20 longitudinally within the inner hollow member 19. FIGS. 3 and 4 illustrate one example comprising a first adjustment mechanism 34 for the inner member 19 and a second adjustment mechanism 35 for the ballast 20. The adjustment mechanism 34 comprises a rack and pinion mechanism which includes a rack 36 formed on or fixed to the inner hollow member 19 and extending longitudinally thereof. The mechanism 32 further includes a pinion 37 meshed with the rack 36 and a drive motor 38 for the pinion 37 mounted on or adjacent to the outer member 14. It will be apparent the operation of the motor 38 in opposite directions will cause opposite rotation of the pinion 37 and cause through the its meshing with the rack 36, the inner member 19 to move longitudinally in opposite directions and thus project outwardly either of one end portion 15 or the opposite end portion 15 of the member 14 as illustrated in dotted outline in FIG. 3.

The adjustment mechanism 35 for the ballast 20 includes an elongated screw 39 which extends longitudinally within the member 19 through a bore 40 in the carrier 27, the screw 39 being in threaded engagement with a nut 41 fixed to the carrier 27. A drive motor 42 is mounted at one end of the member 19 on a support plate 43 and coupled via a gearbox 44 to the screw 39. The screw 39 is supported at the opposite end of the member 19 in a bearing 45. Operation of the motor 42 in opposite directions will cause rotation of the screw 39 in opposite directions about its longitudinal axis and thereby cause through cooperation with the nut 41 adjustment of the position of the ballast 20 longitudinally of and within the member 19.

The drive motors 38 and 42 may be electrical or hydraulic drive motors and may be operated simultaneously or separately to adjust the position of the member 19 and ballast 20 respectively.

Figure 7:
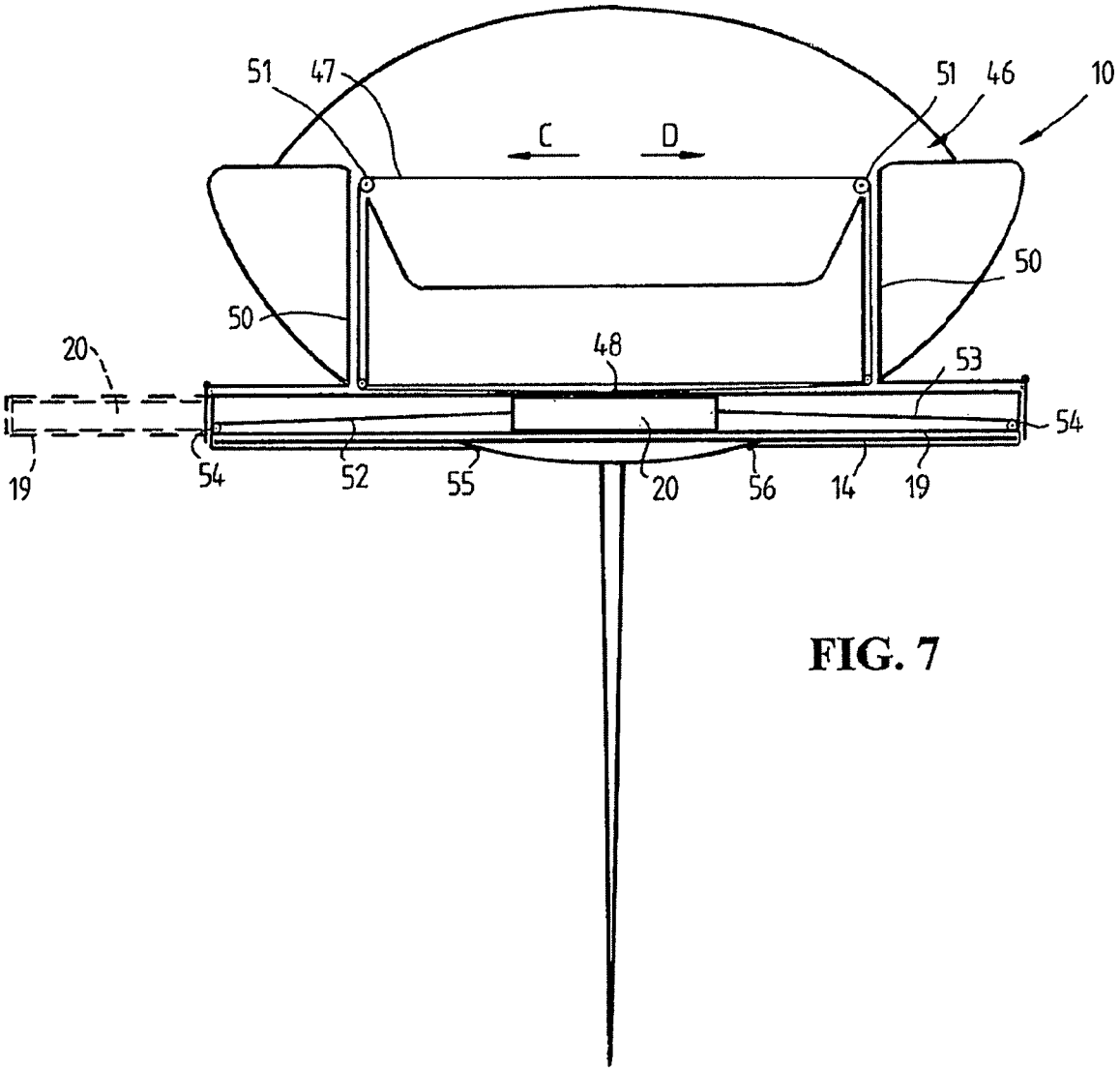
FIG. 7 illustrates schematically an alternative arrangement for adjusting the ballast assembly.

An alternative adjustment mechanism 46 for the member 19 and ballast 20 is shown in FIG. 7 and includes a first endless line or cable 47 which is fixed at 48 to the centre of the member 19 and which extends along and within the outer member 14 and up a pair of guide tubes 50 communicating with and sealed at their lower ends to the outer member 14. The guide tubes 50 extend upwardly to a position substantially above the waterline with the line or cable 47 extending transversely between the upper ends of the guide tubes 50 and being guided by rollers or pulleys 51 on or adjacent the guide tube ends. Movement of the line 47 between the guide tubes 50 in opposite directions indicated by the arrows C and D in FIG. 7 will cause movement of the inner member 19 in opposite longitudinal directions relative to the outer member 14. The line or cable 47 whilst shown in FIG. 6 to be endless may have free opposite ends which extend from the upper ends of the guide tubes 50 and which may be pulled by hand or coupled to respective winches such as hand winches, operation of a selected one of which will apply tension to one cable to effect longitudinal movement of the member 19 longitudinally of the member 14.

To effect movement of the ballast 20, cables or lines 52 and 53 are connected to opposite ends of the ballast 20 and pass out of opposite ends of the inner member 14 and around rollers or pulleys 54 to be secured back to the hull 12 as at 55 and 56. As the member 14 is extended in one direction out of the member 19 for example in the left hand direction of FIG. 7 as shown in dotted outline by moving the line 47 in the direction D, the line 52 will be tensioned and thereby cause the ballast 20 to be also moved to the left. During this movement, tension is release in the opposite line 53. A similar but opposite movement of the ballast 20 occurs in movement of the member 19 in the opposite direction by moving the line 47 in the direction C.

Thus movement of the member 19 in opposite directions also cause movement of the ballast 20 in the same direction simultaneously. Of course, the outer member 19 may be adjusted in position other than by the line 47 for example by the arrangement described with reference to FIGS. 3 and 4.

Figure 8:
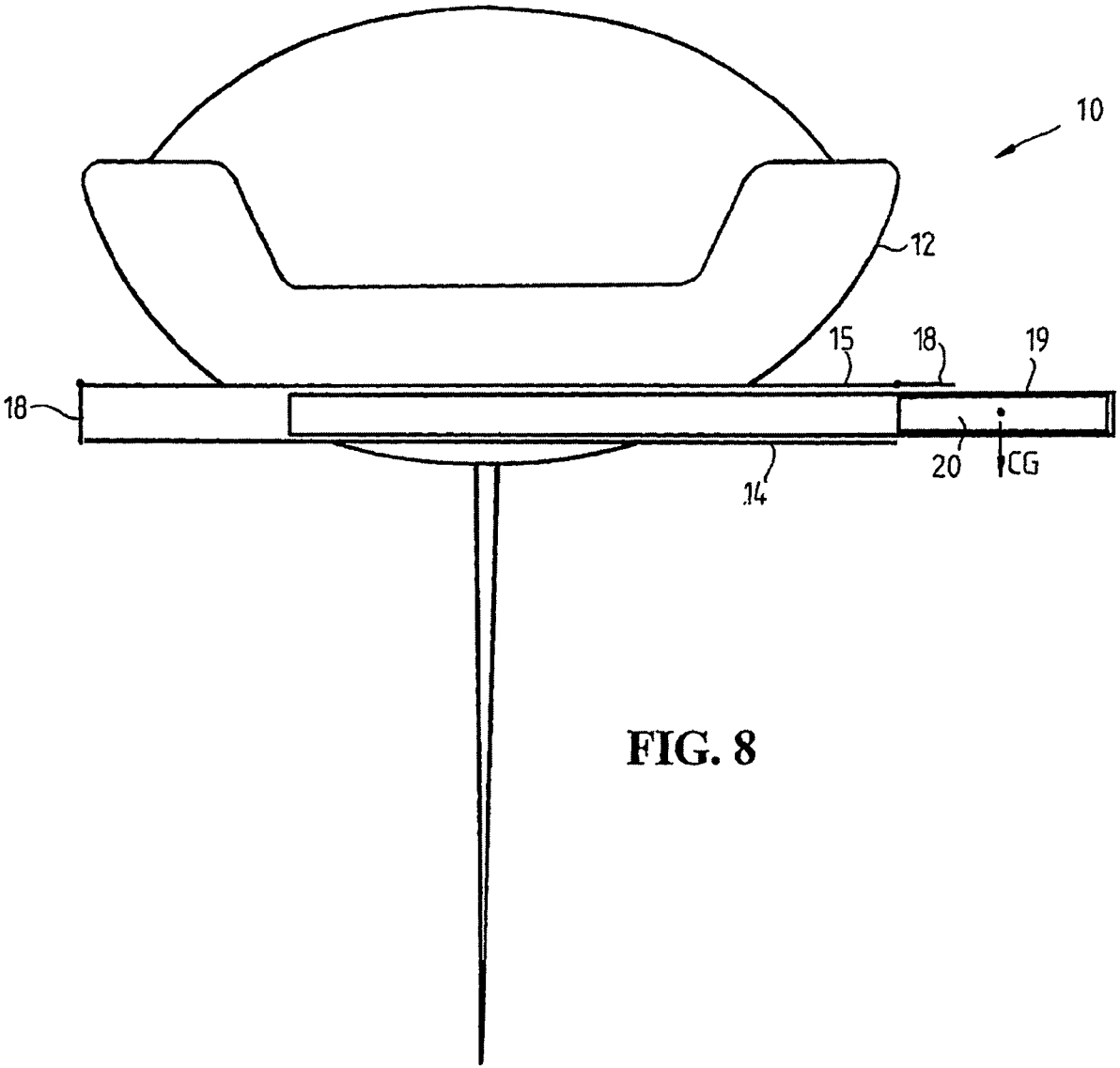
FIG. 8 is a schematic cross sectional view of the yacht of FIG. 1 corresponding to the view of FIG. 3 showing the inner guide and ballast adjusted to a maximum position to starboard.

In use and as shown in FIG. 8, and assuming the ballast 20 is to be adjusted for beating to windward on a starboard tack, the inner guide member 19 is extended beyond the end portion 15 of the member 14 on the starboard side of the yacht 11 using for example the mechanism of FIG. 4 or FIG. 6. During this movement the inner guide member 19 will pivot the fairing 18 open. The inner member 19 is shown at its maximum extended position in FIG. 8. The ballast 20 is also moved to an outward end position to windward such that the centre of gravity of the ballast 20 is shifted laterally outwardly of the hull 12. In this case the ballast 20 is located wholly outwardly of the hull 12. Positioning the ballast 20 to windward laterally outwardly of the hull 12 will provide a counterbalancing force to heeling of the yacht 10 during the starboard tack. If the counterbalancing force is to be reduced, the ballast 20 is moved to port within the inner member 19 which may also be moved depending upon the adjustment mechanism used. In the FIG. 8 position, the pivotally mounted fairing 18 at the opposite end of the member 14 remains closed so to close the end of the member 14 to water entry and reduce drag when heeling.

Depending where the ballast 20 is to be positioned, it can be moved from the centered position of FIG. 3 for running downwind to positions to either side of the centered position and out to its opposite end positions. Where the ballast 20 is in two parts, the two parts may be moved to the opposite end positions to maximize the rolling moment of inertia. In the centered position, the dagger board 13 may be retracted for maximum speed. The described ballast assembly however permits the ballast 20 to be adjusted beyond the extremities of the hull to increase the counterbalancing force thereby eliminating the need to have a heavily ballast daggerboard or keel.

Figure 9:
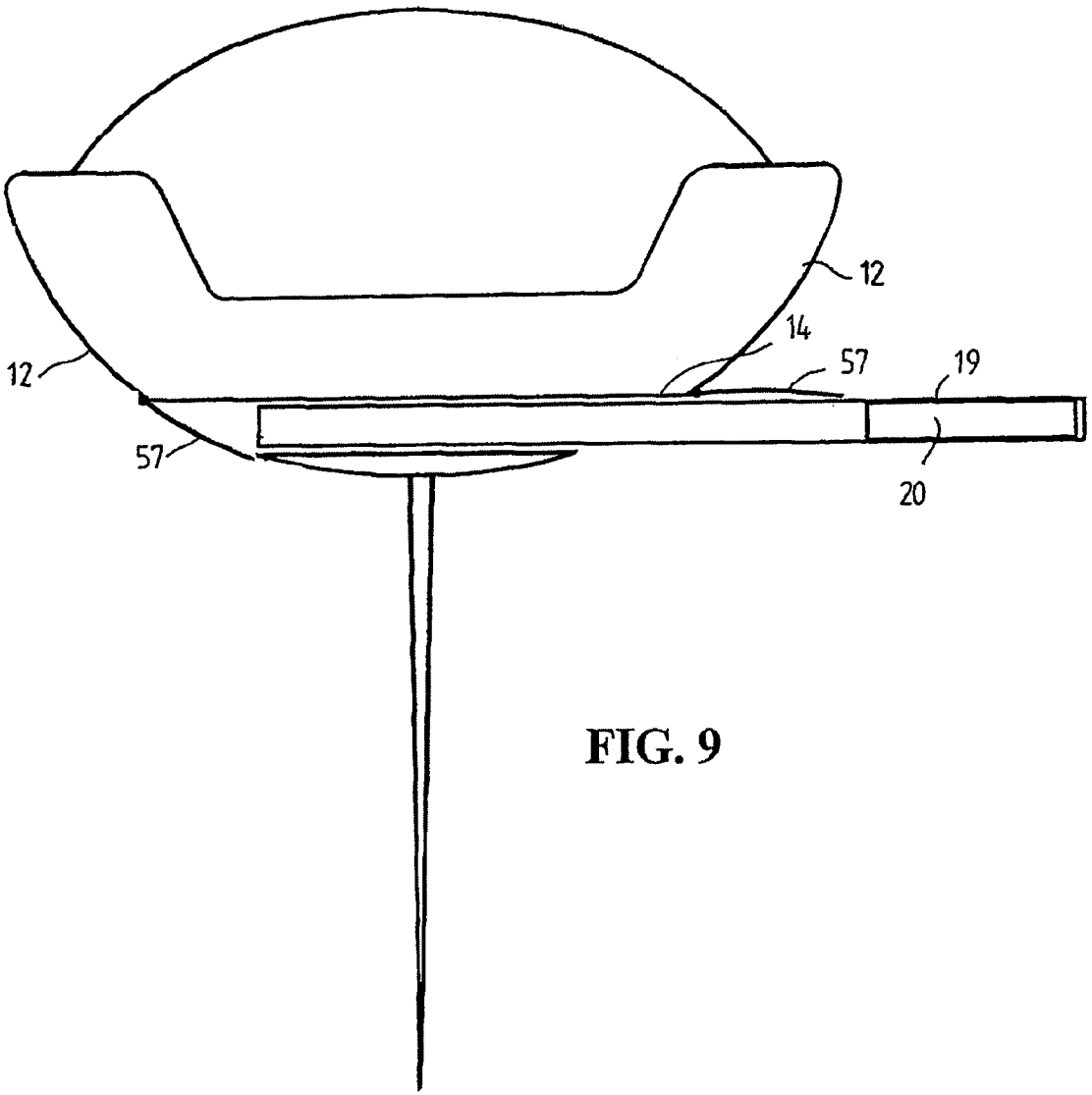
FIG. 9 is a schematic cross sectional view of the yacht of FIG. 1 corresponding to the view of FIG. 3 with a truncated outer guide member.

Whilst the outer hollow member 14 is shown to project beyond the opposite sides of the hull 12 in the embodiments of FIGS. 1 to 6, it may terminate at or adjacent the opposite sides of the hull 12 as shown in FIG. 9 to form a tunnel extending transversely through the hull 12 between its opposite sides. The member 14 as above supports an inner hollow member 19 and ballast 20 which may be adjusted in a similar manner to that previously described. The hull 12 in this case is also fitted with curved fairings 57 which match the curvature of the hull 12 so that when closed, the external surface of the hull 12 remains relatively streamlined whilst the open ends of the outer member 14 will be blocked to reduce drag.

In some circumstances it may be necessary to rapidly retract the ballast 20 and/or inner guide member 19 by moving the ballast 20 and/or guide member 19 to a central position for example if there is a sudden drop in the wind speed or to allow for an emergency tack. For this purpose, emergency switches 58 and 59 may be connected to the motor 34 and the motor 42 as shown in FIG. 3. Operation of either of the switches 58 or 59 will cause operation of the motors 34 and/or 42 move the ballast 20 and/or inner member 14 to a central position. This adjustment may also be effected automatically by using sensors 60 and 61 and associated control circuitry also connected to the motors 34 and 42 respectively. The sensors 60 and 61 sense heel of the yacht 10 and/or acceleration and will, when excessive heel or acceleration is sensed, automatically cause the motors 34 and/or 42 to operate to move the ballast 20 and/or inner member 14 to a central position.

Figure 10:
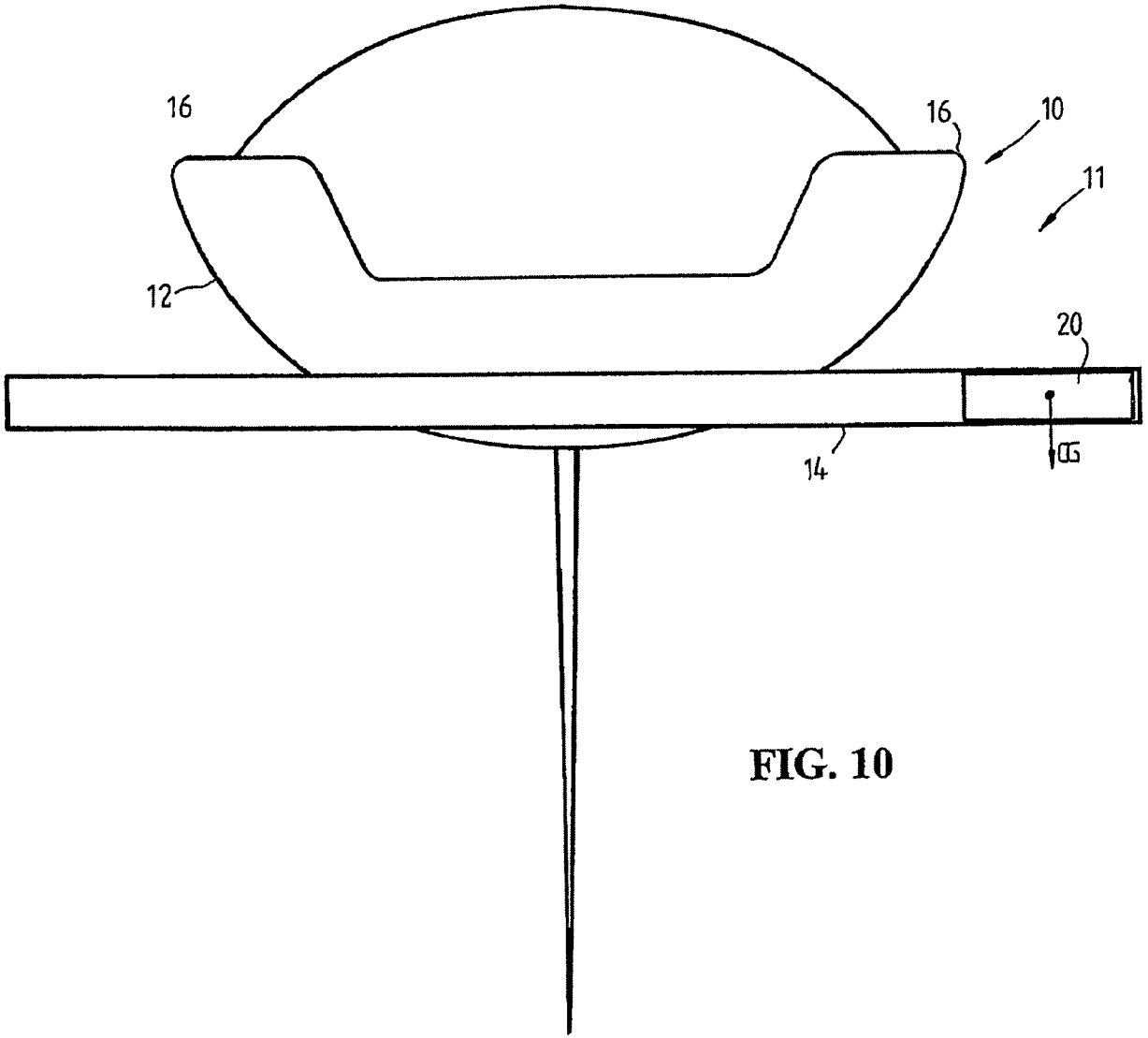
FIG. 10 illustrates a further simplified embodiment of ballast assembly installed within a yacht hull according to the invention.

FIG. 10 illustrates an alternative embodiment of the invention similar to the previous embodiments and in which like components to the previous embodiments have been given like numerals. The ballast assembly 11 in this instance comprises a single hollow guide member 14 which is fixed and sealed to hull and passes through the hull 12 below the waterline and which is of extended length to extend beyond the gunwales 16. The member 14 is closed and sealed at each end to reduce drag. Located within the member 14 is the ballast 20, the ballast 20 being movable along and within the member 14 using for example an adjustment mechanism described with reference to FIGS. 3 and 4. The ballast 20 thus may be moved to positions laterally of the hull 12 so that its centre of gravity can be positioned beyond the sides of the hull 12 and also beyond the gunwales.

The embodiment of the invention has been described in relation to a yacht having a skiff-shaped hull. It will be appreciated however that the present invention may be applied to any form of yacht hull. Further whilst particular adjustment mechanisms for the ballast 20 have been described, many different adjustment mechanisms can be used to enable the ballast 20 and inner guide member 19 to be adjusted.

The terms "comprising" or "comprises" as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as herein described.

The invention claimed is:

1. A mono-hull yacht having a hull and an adjustable ballast assembly, said ballast assembly comprising a ballast, said ballast being mounted to said hull below the waterline thereof for movement transversely of and through said hull and between opposite end positions in which at least part of said ballast is located laterally outwardly of said hull respectively, the center of gravity of said ballast in said opposite end positions being located outwardly of opposite sides of said hull, and elongated ballast guide means for guiding said transverse movement of the ballast, said elongated guide means comprising a first inner elongated hollow guide member and a second outer elongated hollow guide member, said second outer elongated guide member being located at least partly within said hull and extending transversely thereof, said ballast being located within said first inner elongated hollow guide member, said first inner elongated hollow guide member extending longitudinally of and being located within the second guide member for longitudinal movement relative thereto, and a first adjustment mechanism for selectively moving said first inner elongated hollow guide member in opposite directions longitudinally of said second guide member whereby said first inner elongated hollow guide member can project telescopically outwardly of opposite ends of the second guide member and a second adjustment mechanism for selectively moving said ballast in said first inner elongated hollow guide member between said opposite end positions.

2. A yacht as claimed in claim 1 wherein said second outer elongated hollow guide member is mounted to the hull such that opposite end portions thereof extend laterally outwardly of said hull.

3. A yacht as claimed in claim 2 wherein said end portions do not extend beyond the maximum beam of the hull so as not to increase the maximum hull beam.

4. A yacht as claimed in claim 1 wherein said second outer elongated hollow guide member terminates substantially flush with opposite sides of the hull.

5. A yacht as claimed in claim 1 wherein at least opposite end portions of said first inner elongated hollow guide member have a foil shape so as to reduce drag within water.

6. A yacht as claimed in claim 1 wherein said first guide member is of substantially the same length as the second outer hollow guide member such that it may be located wholly therein when in a central position.

7. A yacht as claimed claim 1 wherein said first and second adjustment mechanisms comprise one of a cable/line and pulley, a screw jack, or a rack and pinion.

8. A yacht as claimed in claim 1 wherein said ballast remains wholly within the first inner elongated hollow guide member in all positions and wherein said first inner elongated hollow guide member is sealed at opposite ends to prevent entry of water into the first inner elongated hollow guide member.

9. A yacht as claimed in claim 1 and wherein said yacht includes a keel extending from said hull, said keel comprising a fixed or retractable keel or centreboard.

10. An adjustable ballast assembly for a mono-hull yacht having a hull, said ballast assembly comprising a ballast, elongated ballast guide means adapted to mounted to said hull to extend transversely of said hull, said guide means being adapted to guide movement of said ballast through said hull and between respective opposite end positions in which at least part of said ballast is located in use laterally outwardly of said hull, said guide means comprising a first elongated hollow guide member, a second elongated hollow guide member adapted to be mounted to said yacht hull, said first elongated guide member extending longitudinally of and being located within the second elongated hollow guide member for longitudinal movement relative thereto, and a first adjustment mechanism for selectively moving said first elongated hollow guide member longitudinally of said second elongated hollow guide member whereby said first elongated hollow guide member can project telescopically outwardly of opposite ends of the second elongated hollow guide member, said ballast being located within said first elongated hollow guide member and a second adjustment mechanism for selectively moving said ballast longitudinally of said first elongated hollow guide member between said opposite end positions.

* * * * *

UNITED STATES PATENT AND TRADEMARK OFFICE

CERTIFICATE OF CORRECTION

PATENT NO. : 7,849,809 B2
APPLICATION NO. : 12/295886
DATED : December 14, 2010
INVENTOR(S) : Gale It is certified that error appears in the above-identified patent and that said Letters Patent is hereby corrected as shown below:

In column 12, line 1, should read:

"elongated ballast guide means adapted to --be-- mounted to said"

Signed and Sealed this
First Day of March, 2011

David J. Kappos

David J. Kappos
*Director of the United States Patent and Trademark Office*